US006932290B2

(12) United States Patent
Virving

(10) Patent No.: US 6,932,290 B2
(45) Date of Patent: Aug. 23, 2005

(54) REFINING SEGMENT AND A REFINING APPARATUS COMPRISING A REFINING DISC WITH SUCH REFINING SEGMENT

(75) Inventor: Nils Virving, Hässelby (SE)

(73) Assignee: Valmet Fibertech AB (SE)

( * ) Notice: Subject to any disclaimer, the term of this patent is extended or adjusted under 35 U.S.C. 154(b) by 125 days.

(21) Appl. No.: 10/297,517

(22) PCT Filed: Jun. 7, 2001

(86) PCT No.: PCT/SE01/01283

§ 371 (c)(1),
(2), (4) Date: May 29, 2003

(87) PCT Pub. No.: WO01/94021

PCT Pub. Date: Dec. 13, 2001

(65) Prior Publication Data

US 2003/0183712 A1 Oct. 2, 2003

(30) Foreign Application Priority Data

Jun. 8, 2000 (SE) ..... 0002155

(51) Int. Cl.[7] ..... B02C 7/12
(52) U.S. Cl. ..... 241/298
(58) Field of Search ..... 241/261.2, 261.3, 241/296, 297, 298

(56) References Cited

U.S. PATENT DOCUMENTS 1,624,037 A * 4/1927 Butler ..... 241/261
4,600,475 A 7/1986 Reinhall et al.
5,042,726 A * 8/1991 Reinhall ..... 241/28
5,950,946 A * 9/1999 Kjellqvist et al. ..... 241/261.2

FOREIGN PATENT DOCUMENTS

SE 435 737 B1 10/1984

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Apparatus for use as at least a portion of the refining surface of a refining disk is disclosed for use in a refiner for lignocellulosic material disposed in a refiner housing, the apparatus including a refiner segment having a periphery and mountable on the refining disk in juxtaposition with an opposing refining disk for treating the lignocellulosic material in the refining gap therebetween and a guide disposed along the entire periphery of the refining segment whereby lignocellulosic material leaving the refining gap is deflected from being thrown directly against the refiner housing.

11 Claims, 3 Drawing Sheets

REFINING SEGMENT AND A REFINING APPARATUS COMPRISING A REFINING DISC WITH SUCH REFINING SEGMENT

FIELD OF THE INVENTION

The present invention relates to a refining segment constituting at least part of a refining disk included in refining apparatus for disintegrating and refining material containing lignocellulose in a refining gap between two opposing refining disks rotatable in relation to each other, surrounded by a refiner housing. More particularly the present invention also relates to a refining apparatus comprising a refining disk that includes one or more such refining segments.

BACKGROUND OF THE INVENTION

Refining apparatus or disk refiners of the above-described type are used, for instance, for highly concentrated defining, CTMP, TMP, fluffing and highly concentrated grinding of sack paper and other fibrous material containing lignocellulose. They usually comprise a rotatable refininq disk, mounted on a rotor, and a non-rotatable refining disk, mounted on a stator. Refining disks in this type of refining apparatus are built up of refining segments that form refining surfaces. The refining segments are replaced at regular intervals due to considerable wear. They are either mounted directly on the rotor and stator, respectively, or by means of special segment holders. A refining disk may consist of one or more annular refining segments or of several divided, radial refining segments. Refining segments may be in the form of central segments and peripheral segments, the peripheral segments being located outermost along the periphery, and the central segments being located inside the peripheral segments. Between the refining disk/surfaces on the rotor and stator, respectively, is a space in the form of a refining gap.

A serious problem with this type of refining apparatus is that the refined material is thrown out in the form of pulp from the refining zone, i.e. the refining gap between the refining disks, straight into the wall of the surrounding refiner housing, thus causing considerable strain on the wall, as well as substantial wear. This applies particularly when impurities in the form of clay and sand are present in the pulp, as is the case primarily with board and return fiber pulp. According to conventional technology, a special wear part is sometimes installed, suitably situated, inside the refiner housing, which is replaced at regular intervals. This naturally entails some extra expense but otherwise the housing itself would be worn out, which obviously should be avoided. One object of the present invention is primarily to remedy this problem.

Another problem is that the pulp thrown out not only causes wear on the wall of the refiner housing but may also become lodged on it and build up to a pulp cake. This occurs primarily between the rotatable parts and the refiner housing. This cake of pulp sometimes tends to become lodged and completely block transport of fibers to the outlet. Besides this obvious drawback, the build-up of pulp in the refiner housing also results in high friction along the periphery of the rotatable parts, and also considerable generation of heat which may cause the fibers to carbonize, becoming so hard that the rotor is turned as by a lathe, and may cause breakdown. Even if things do not reach this stage, the build-up of pulp causes continuous wear on the outer part of the rotor and the segment holder of the refining disk when used, so that they may break down in the end. Equivalent problems may also arise in refining apparatus of "double disk" type, i.e. having two refining disks rotatable against each other.

According to conventional technology attempts to eliminate these problems entail providing the rotor itself with wings that protrude into the space between the rotor and the wall of the refiner housing to keep it clean. However, these wings often give rise to cavitation damage in the attachment between wing and rotor, which may lead to the wing gradually becoming dislodged, with disastrous consequences.

SUMMARY OF THE INVENTION

In accordance with the present invention, these and other objects have now been realized by the invention of apparatus for use as at least a portion of the refining surface of a refining disk having an outer periphery for use in a refiner for lignocellulosic material disposed in a refiner housing, the apparatus comprising a refiner segment having a periphery and mountable on the refining disk in juxtaposition with an opposing refining disk with a refining gap therebetween for treating the lignocellulosic material and a guide member disposed along the entire periphery of the refining segment whereby lignocellulosic material leaving the refining gap is deflected from being thrown directly against the refiner housing. Preferably, the refining disk comprises a rotatable refining disk, rotatable in a predetermined direction of rotation.

In accordance with one embodiment of the apparatus of the present invention, the guide member is adapted to deflect the lignocellulosic material at an angle of up to 90° with respect to the refining surface formed on the refining disks. In a preferred embodiment, the guide member is adapted to deflect the lignocellulosic material at an angle of between 45° and 60°.

In accordance with one embodiment of the apparatus of the present invention, the guide member comprises a guide lip protruding outside the refining gap and in a direction substantially towards the opposed refining disk.

In accordance with another embodiment of the apparatus of the present invention, the guide member comprises a portion of the refining segment unitary therewith.

In accordance with another embodiment of the apparatus of the present invention, the refining segment comprises a divided radial refining segment.

In accordance with another embodiment of the apparatus of the present invention, the refining segment comprises an annular refining segment.

In accordance with another embodiment of the apparatus of the present invention, the refining disk comprises a nonrotatable refining disk.

In accordance with the present invention, apparatus has been discovered for refining lignocellulosic material comprising a pair of juxtaposed refining disks defining a refining gap for the lignocellulosic material therebetween, the refining disks being relatively rotatable with respect to each other, a refiner housing for the refiner, one of the pair of refining disks including a refining segment having a periphery, and a guide member disposed along the entire periphery of the refining segment whereby lignocellulosic material leaving the refining gap is deflected from being thrown directly against the refiner housing.

In a preferred embodiment, the apparatus includes a plurality of the refining segments disposed on the at least one of the pair of refining disks, wherein each of the plurality of refining segments includes the guide member.

In accordance with another embodiment of the apparatus of the present invention, the at least one of the refining disks comprises a nonrotatable refining disk.

Further in accordance with the present invention, the problems mentioned above are remedied by making use of a refining segment provided along its entire periphery with a guide member for deflecting the refined material when it leaves the refining gap, so that it is not thrown directly against the wall of the refiner housing. Thanks to the present invention, the advantage is thus gained of avoiding a good deal of the wear on the wall of the refiner housing immediately outside the refining gap by the pulp being guided forwards instead, along the periphery of the opposing refining disk and, insofar as it encounters the wall of the refiner housing, being spread over a larger area and encountering the wall with less force. The wear where the pulp encounters the wall of the refiner housing will thus be less and the tendency to build up a pulp cake is greatly reduced. Admittedly, the wear on the actual guide member is rather great, but this poses no real problem since, in accordance with the proposed solution, they are joined to the refining segments and replaced simultaneously therewith. This is performed as a matter of routine, usually about once a month.

The guide member is designed to produce a deflection angle of up to 90° in relation to the substantially parallel refining surfaces formed by the two refining disks, preferably 45°–60°

In accordance with a preferred embodiment of the present invention, the guide member is in the form of a guiding lip along the periphery of the refining segment and protrudes outside the refining gap and substantially in the direction towards the opposing refining disk. The guide member is preferably made in one piece with the refining segment, which is usually cast. However, it is of course feasible for it to be a separate part which, for instance, is screwed onto the refining segment.

The refining segment in accordance with the present invention may be a divided, radial refining segment situated along the periphery of the refining disk and provided with a guide member along its entire periphery, or it may be an annular refining segment provided with a guide member along its entire periphery.

The present invention also relates to a refining apparatus provided with a refining disk with such refining segments.

BRIEF DESCRIPTION OF THE DRAWINGS

The present invention will now be described with reference to the accompanying detailed description, which, in turn, refers to the drawings, illustrating embodiments of the present invention by way of example, in which.

DETAILED DESCRIPTION

Figure 1:
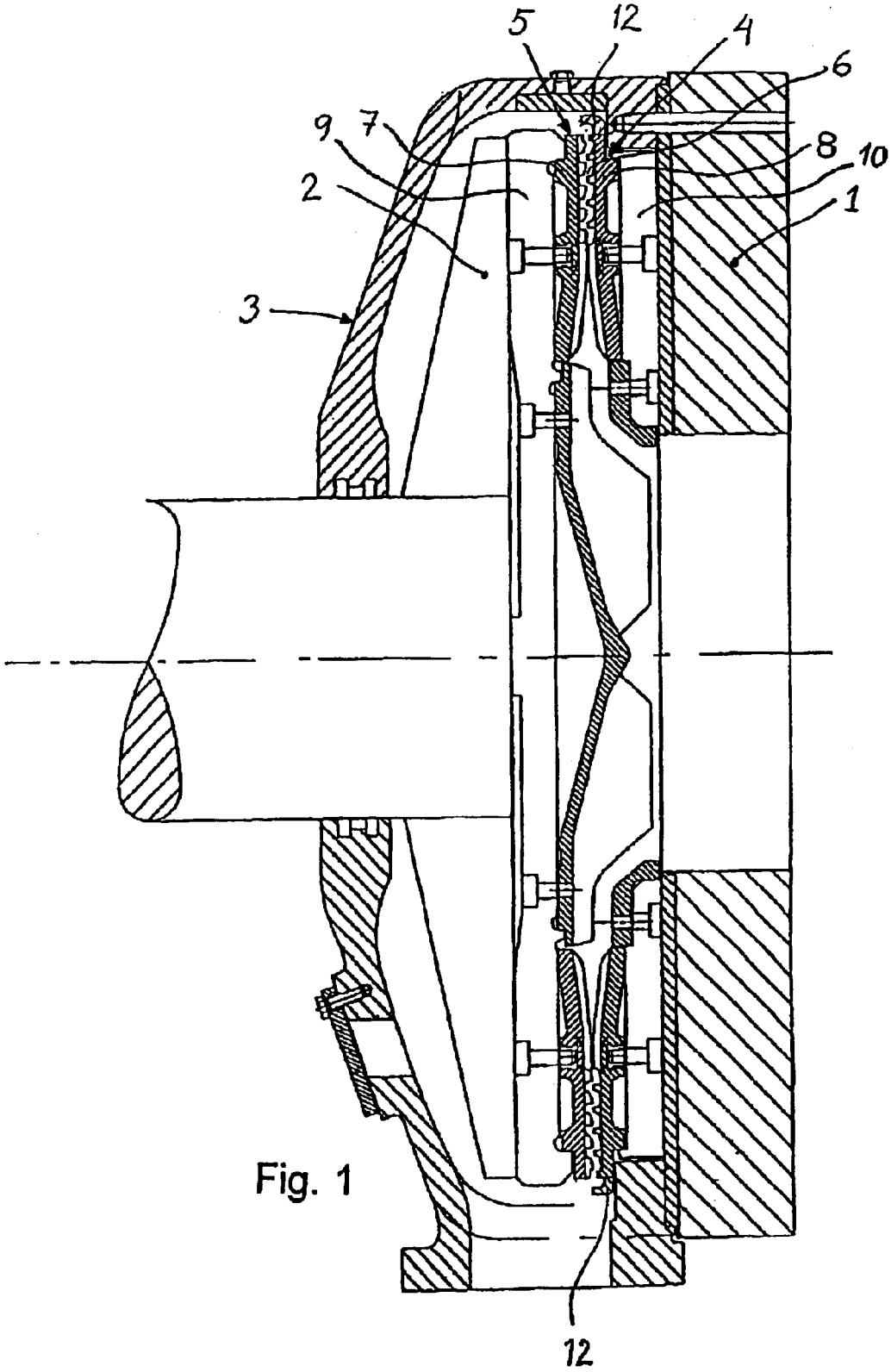
FIG. 1 is a side, elevational, cross-sectional view of a disk refiner in accordance with the present invention.

Referring to the drawings, FIG. 1 illustrates a disk refiner comprising a stationary part, stator 1, and a rotatable part, rotor 2, surrounded by a refiner housing 3. Refining disks, 4 and 5, are mounted on stator and rotor, respectively. These refining disks are generally divided into segments, known as refining segments or stator segments 8 and rotor segments 7, respectively, forming refining surfaces. The refining segments are normally pre-fitted on segment holders, 9 and 10, respectively, in order to enable quick exchanging. The number of segments may vary, as mentioned above. A stator refining disk generally has eight, twelve or eighteen segments and a rotor refining disk usually has the same number of segments. Alternatively, whole, i.e. undivided, refining disks are also possible in the case of small refineries.

A refining gap 6 is produced between the refining surfaces, where the material fed in is refined.

Figure 2:
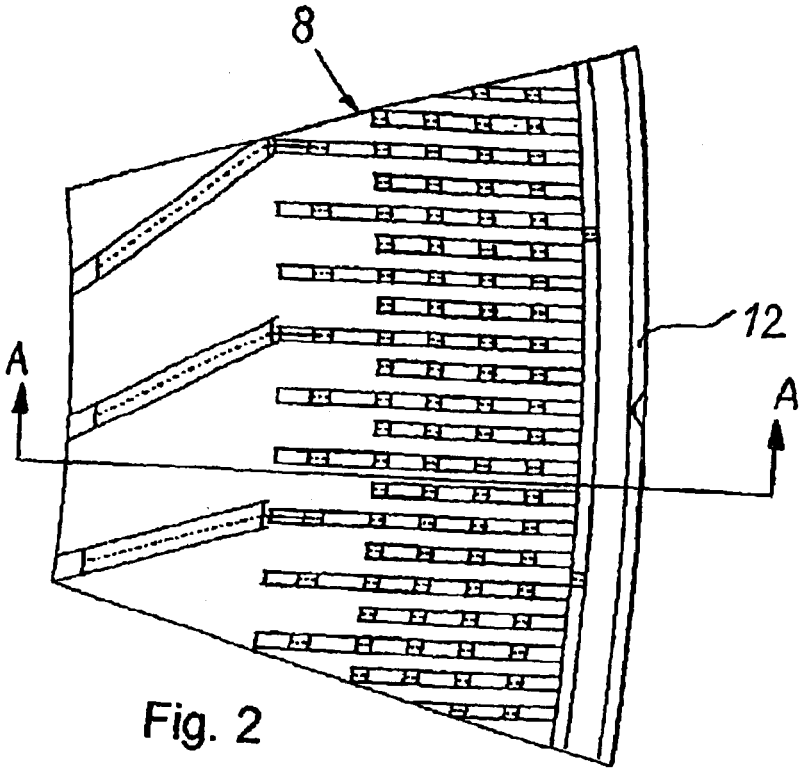
FIG. 2 is a top, elevational, enlarged view of an embodiment of a refining segment in accordance with the present invention.
Figure 3:
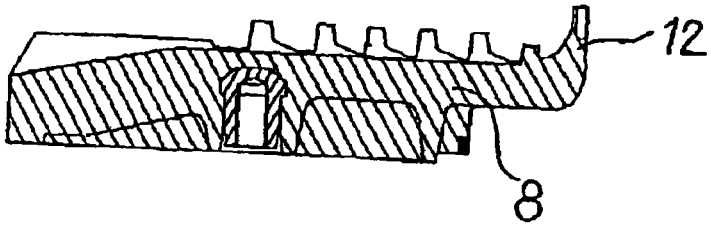
FIG. 3 is a side, elevational, enlarged cross-sectional view of the refining segment shown in FIG. 2, taken along the line A—A thereof, or alternatively the refining segment in FIG. 4 below, taken along the line B—B thereof.

A refining segment 8 for a stator refining disk in accordance with one embodiment of the present invention is illustrated in detail in FIGS. 2 and 3. A "divided" refining segment or radial refining segment is seen here, intended to be placed along the periphery of the refining disk and which, together with a number of additional segments, forms the refining disk. The refining segment is provided along its entire periphery with a guiding lip 12 or overhang in the direction towards the opposing refining disk, in this case the rotor. The guiding lip protrudes outside the refining gap, see also FIG. 1, so that the refined material ejected from the refining gap is caught by the guiding lip and deflected inside the refiner housing with the aid thereof, in a direction substantially axially along the periphery of the rotor 2. Since it is advisable for all the outer, refining segments situated along the periphery of the stator refining disk 4 to be designed in the manner shown with a guiding lip along their entire periphery, a guiding lip similar to an unbroken ring or flange will be formed along the entire periphery of the stator disk. The guiding lip 12 is designed so that it forms an angle in relation to the refining surface formed by the refining disk, that produces a deflection of up to 90° in relation to the refining surface, but preferably between 45° and 60°.

Figure 4:
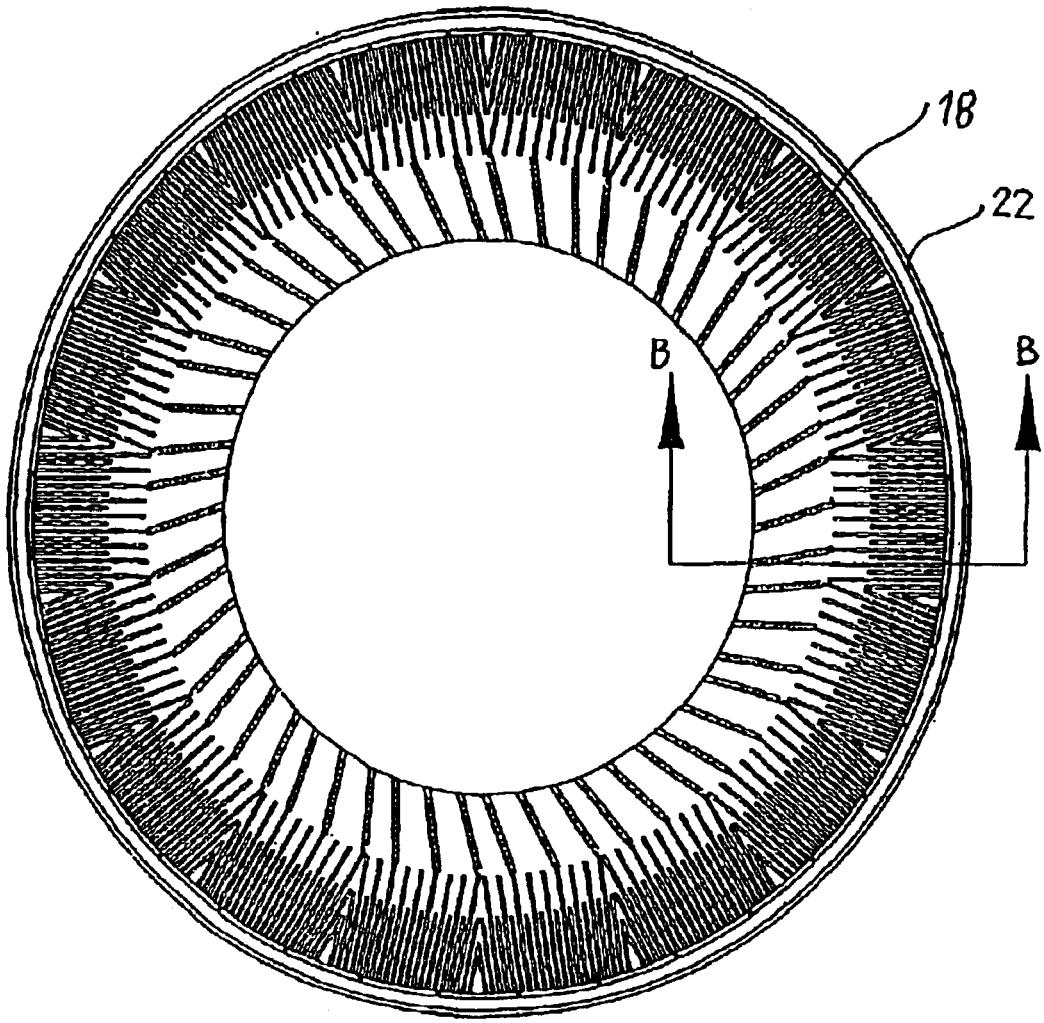
FIG. 4 is a top, elevational view of a variant of a refining segment in accordance with the present invention, on a reduced scale.

FIG. 4 illustrates a variant of a refining segment. This refining segment 18 is an annular refining segment provided with a guiding lip 22 along its entire periphery. The guiding lip is designed as shown in FIGS. 1 and 3 and a cross section of the refining segment 18 will be the same as shown in FIG. 3.

For both variants the guiding lip is preferably made in one piece with the refining segment, and of the same material, preferably with a rounded transition between the segment itself and the guiding lip. However, the guiding lip could also consist of a separate part secured to the periphery of the refining segment in suitable manner.

It should be particularly noted that the refining segment in accordance with the present invention need not necessarily be mounted on a non-rotatable stator refining disk, but may instead be mounted on a rotatable refining disk, e.g. in refining apparatus of double-disk type.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for use as at least a portion of the refining surface of a refining disk having an outer periphery for use in a refiner for lignocellulosic material disposed in a refiner housing, said apparatus comprising a refiner segment having a periphery and mountable on said refining disk in juxtaposition with an opposing refining disk with a refining gap therebetween for treating said lignocellulosic material and a guide member disposed along said entire periphery of said refining segment, said guide member including a guide lip protruding outside said refining gap and in a direction substantially towards said opposed refining disk, whereby lignocellulosic material leaving said refining gap is deflected from being thrown directly against said refiner housing.

2. The apparatus of claim 1 wherein said refining disk comprises a rotatable refining disk, rotatable in a predetermined direction of rotation.

3. The apparatus of claim 1 wherein said guide member is adapted to deflect said lignocellulosic material at an angle of up to 90° with respect to said refining surface formed on said refining disks.

4. The apparatus of claim 3 wherein said guide member is adapted to deflect said lignocellulosic material at an angle of between 45° and 60°.

5. The apparatus of claim 1 wherein said guide member comprises a portion of said refining segment unitary therewith.

6. The apparatus of claim 1 wherein said refining segment comprises a divided radial refining segment.

7. The apparatus of claim 1 wherein said refining segment comprises an annular refining segment.

8. The apparatus of claim 1 wherein said refining disk comprises a nonrotatable refining disk.

9. Apparatus for refining lignocellulosic material comprising a pair of juxtaposed refining disks defining a refining gap for said lignocellulosic material therebetween, said refining disks being relatively rotatable with respect to each other, a refiner housing for said refiner, one of said pair of refining disks including a refining segment having a periphery, and a guide member disposed along said entire periphery of said refining segment, said guide member including a guide lip protruding outside said refining gap and in a direction substantially towards said opposed refining disk, whereby lignocellulosic material leaving said refining gap is deflected from being thrown directly against said refiner housing.

10. The apparatus of claim 9 including a plurality of said refining segments disposed on said at least one of said pair of refining disks, wherein each of said plurality of refining segments includes said guide member.

11. The apparatus of claim 9 wherein said at least one of said refining disks comprises a nonrotatable refining disk.

* * * * *